US005249995A

United States Patent [19]

Meisenburg et al.

[11] Patent Number: 5,249,995

[45] Date of Patent: Oct. 5, 1993

[54] MARINE DRIVE HAVING TWO COUNTER-ROTATING SURFACING PROPELLERS AND DUAL PROPELLER SHAFT ASSEMBLY

[75] Inventors: Gary L. Meisenburg; Edward C. Eick; Charles M. Mixon; Phillip D. Magee, all of Stillwater, Okla.; Robert B. Weronke, Oshkosh, Wis.

[73] Assignee: Brunswick Corporation, Skokie, Ill.

[21] Appl. No.: 889,530

[22] Filed: May 27, 1992

[51] Int. Cl.[5] ..... B63H 5/10

[52] U.S. Cl. ..... 440/81; 416/128; 416/129; 464/182

[58] Field of Search ..... 440/80, 81, 75, 83, 440/78-81, 900; 416/128, 129; 464/182, 902, 160, 161; 411/383, 384, 389; 384/303; 74/416, 417, 423

[56] References Cited

U.S. PATENT DOCUMENTS

| | | | |
|---|---|---|---|
| 3,952,686 | 4/1976 | Pichl | 440/83 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/81 |
| 4,792,315 | 12/1988 | Karrasch | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland | 440/83 |
| 4,869,121 | 9/1989 | Meisenburg | 74/323 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John | 440/81 |

*Primary Examiner*—Robert J. Oberleitner
*Assistant Examiner*—Clifford T. Bartz
*Attorney, Agent, or Firm*—Andrus, Sceales, Starke & Sawall

[57] ABSTRACT

A marine drive (10) has two counter-rotating surface operating propellers (12, 14). Inner and outer concentric counter-rotating propeller shafts (40, 42) are supported by a spool assembly (38) locked and retained against rotation and against axial movement in the lower horizontal bore (28) in the torpedo (34) of the drive housing (26) by axially spaced left and right hand threads (44 and 46). A thrust bearing assembly (98) transfers thrust from the outer propeller shaft to the inner propeller shaft during rotation of the propeller shafts in opposite axial direction and is axially located between fore and aft driven gears (76 and 78). Propeller shaft sealing and bearing structure, and propeller self-centering mounting structure is provided.

21 Claims, 3 Drawing Sheets

MARINE DRIVE HAVING TWO COUNTER-ROTATING SURFACING PROPELLERS AND DUAL PROPELLER SHAFT ASSEMBLY

BACKGROUND AND SUMMARY

The invention relates to a marine drive having two counter-rotating surface operating propellers.

The present invention arose during development efforts directed toward a marine drive enabling increased top end boat speed. This is achieved by raising the torpedo out of the water to reduce drag, and by using two counter-rotating surface operating propellers. Reducing torpedo drag by raising the torpedo above the surface of the water is known in the art, for example U.S. Pat. No. 4,871,334, column 3, lines 35+.

In one aspect of the invention, simple, effective retaining structure is provided for holding the propeller-bearing-supporting spool in the horizontal bore of the torpedo fixed for non-rotation in each of the opposite rotational directions of the counter-rotating propellers. This prevents rotational loosening of the spool in each of the rotational directions as the propellers strike and pierce the surface of the water.

In another aspect, structure is provided to minimize shaft wobble tendency as the propellers strike and pierce the surface of the water.

In another aspect, a thrust bearing is provided which transfers thrust from a hollow outer propeller shaft to an inner counter-rotating concentric propeller shaft. The thrust bearing is located between fore and aft driven gears on the propeller shafts. The propeller shafts float within their respective gears.

In another aspect, combinations of carbon steel and stainless steel are provided for the propeller shafts to afford bearing support and corrosion protection where needed.

In another aspect, propeller self-centering mounting structure is provided to maintain proper propeller mounting notwithstanding surface operation vibration as the propellers strike and pierce the surface of the water.

DETAILED DESCRIPTION

Figure 1:
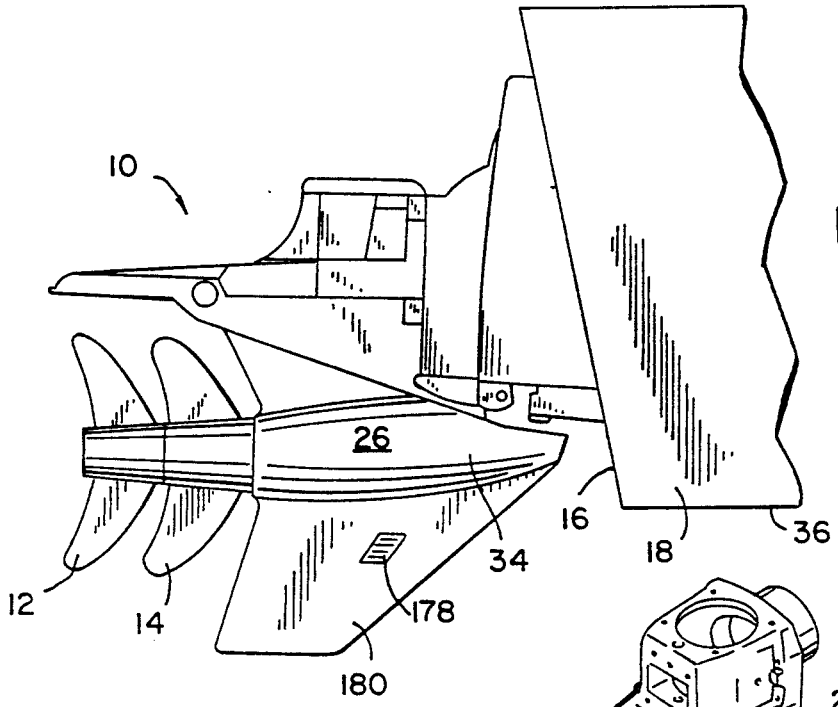
FIG. 1 is a side elevation view of a marine drive in accordance with the invention.
Figure 2:
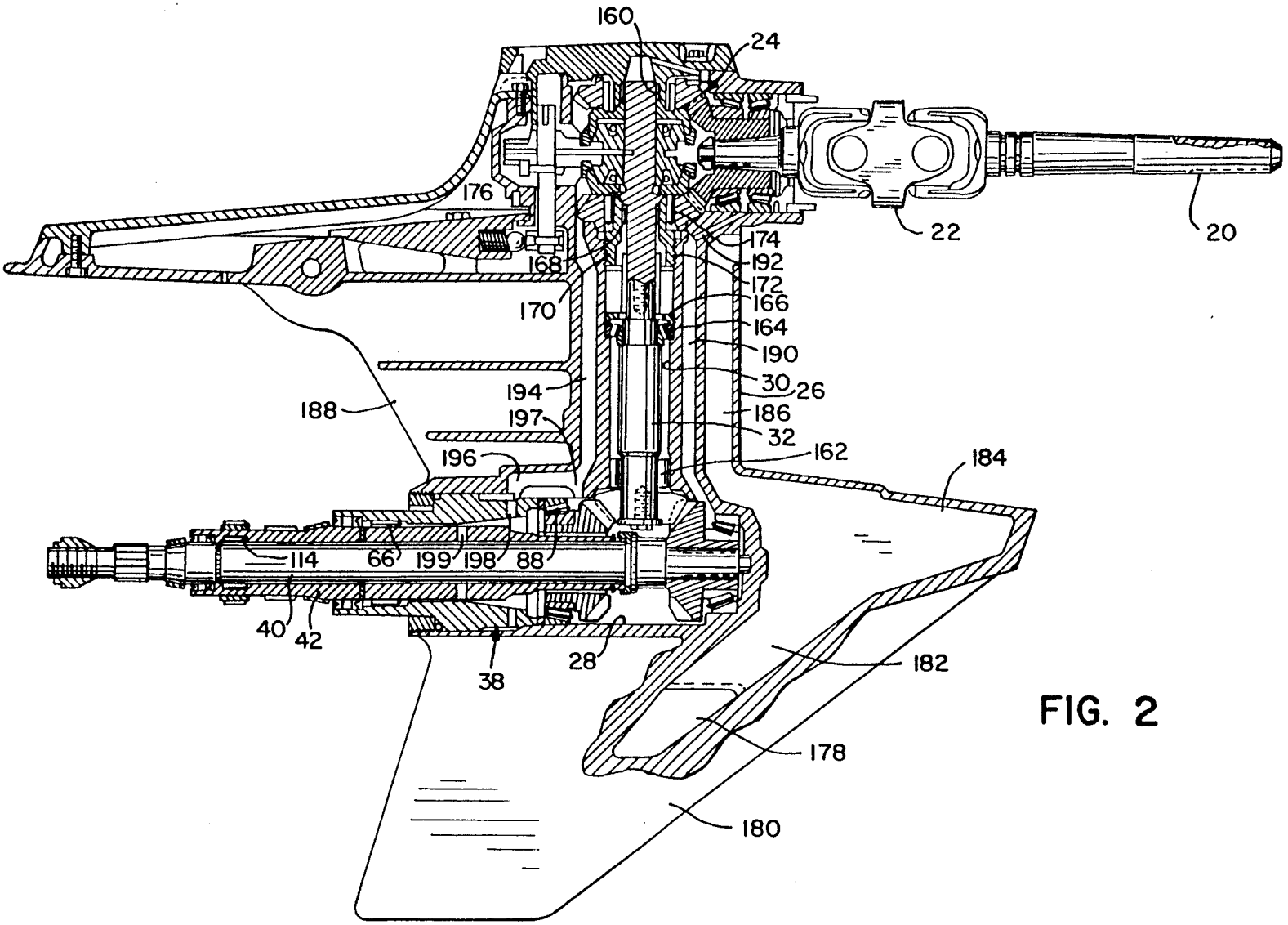
FIG. 2 is a partial sectional view of a portion of the structure of FIG. 1.

FIG. 1 shows a marine drive 10 having two counter-rotating surface operating propellers 12 and 14. The drive is mounted to the transom 16 of a boat 18 according to the usual marine stern drive mounting arrangement. An input shaft 20, FIG. 2, is driven by an engine (not shown) in the boat. Input shaft 20 is coupled through a universal joint 22 to an upper gear and clutch mechanism 24 which is known in the art, as shown in U.S. Pat. Nos. 4,630,719, 4,679,682, and 4,869,121, incorporated herein by reference. Universal joint 22 allows trimming and steering of the drive.

Figure 4:
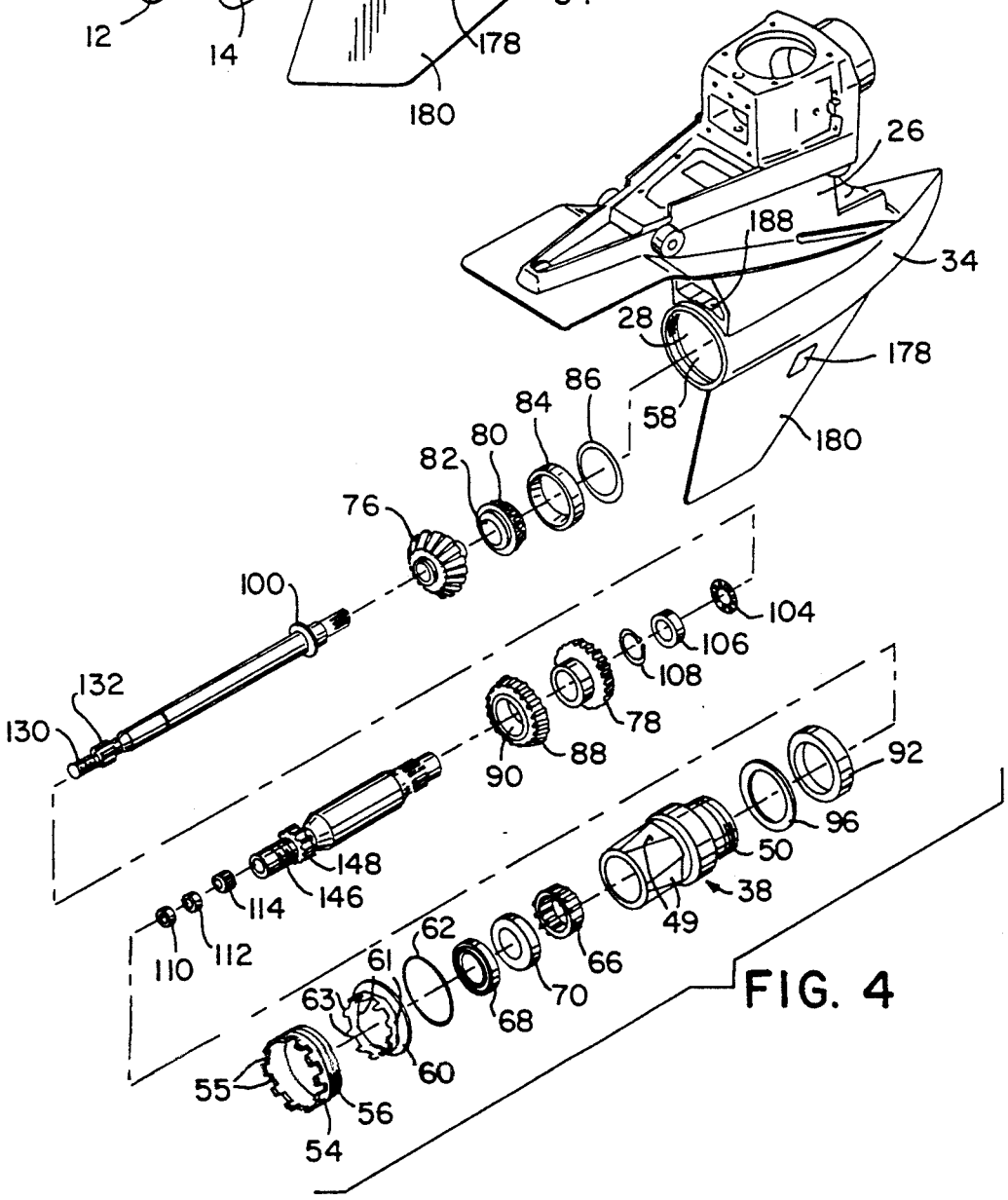
FIG. 4 is an exploded perspective view of a portion of the structure of FIG. 1.
Figure 3:
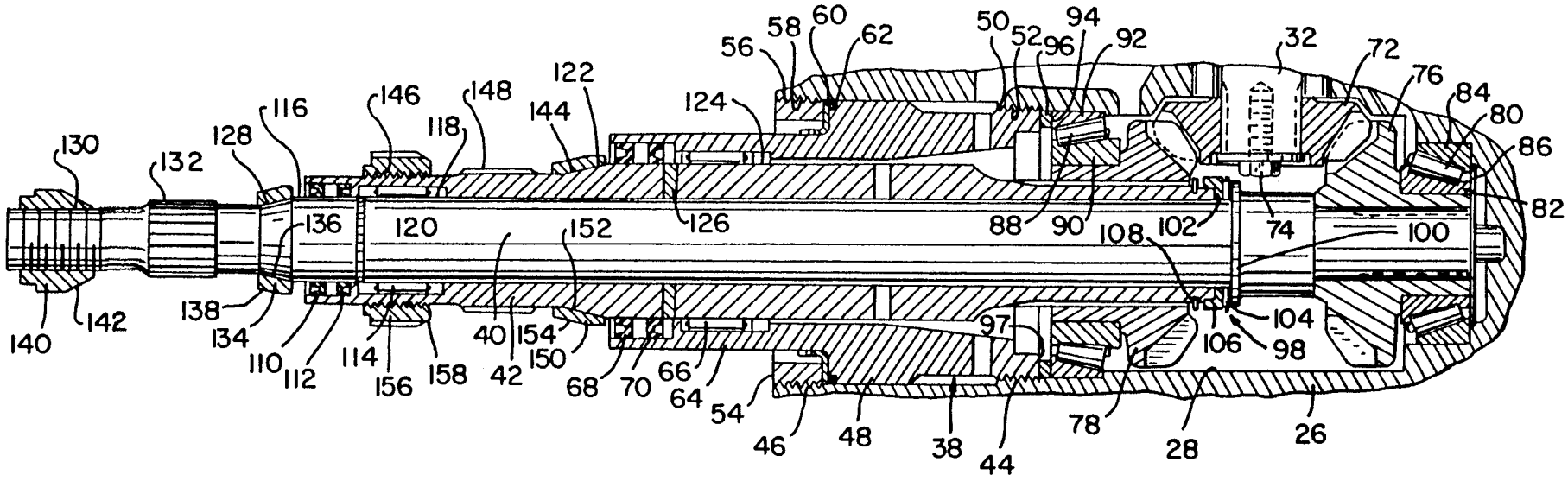
FIG. 3 is an enlarged view of a portion of the structure of FIG. 2.

Drive housing 26 has a horizontal bore 28 and an intersecting vertical bore 30 therein. Upper gear mechanism 24 drives a vertical driveshaft 32 positioned in vertical bore 30. Horizontal bore 28 is in the portion of the drive housing called the torpedo 34, FIG. 4. In the preferred embodiment, FIG. 1, torpedo 34 is spaced slightly above the bottom 36 of the boat such that torpedo 34 is slightly above the surface of the water. A spool assembly 38, FIG. 3, is positioned in horizontal bore 28 of housing 26 and supports a first inner propeller shaft 40 and a second hollow outer propeller shaft 42. Propeller shaft 42 is positioned concentrically over propeller shaft 40. The propeller shafts rotate in opposite rotational directions. Surface operating propeller 12 is mounted to propeller shaft 40. Surface operating propeller 14 is mounted to propeller shaft 42. One of the propellers is a right hand rotating propeller, and the other propeller is a left hand rotating propeller.

Retaining structure is provided for holding the spool assembly 38 fixed for non-rotation within horizontal bore 28 in both rotational directions as the propellers strike and pierce the surface of the water. The retaining structure is provided by a first right hand thread set 44, FIG. 3, and a second left hand thread set 46. The thread sets are spaced along the rotational axis of the propeller shafts. Right hand thread set 44 prevents right hand rotational loosening of the spool assembly. Left hand thread set 46 prevents left hand rotational loosening of the spool assembly. The spool assembly includes a cylindrical bearing support housing 48, FIGS. 3 and 4, having a mounting thread 50 thereon for engagement with a mounting thread 52 in bore 28 of housing 26. The spool assembly also includes a cylindrical ring locking member 54 having a left hand thread 56 for engagement with a mating thread 58 in bore 28 of housing 26, for clamping against bearing support housing 48 to fix the rotational and axial position of both bearing support housing 48 and locking member 54 in horizontal bore 28, whereby rotation of the spool assembly is prevented in each rotational direction. A locking tab washer 60 is provided between locking member 54 and bearing support housing 48, and O-ring 62 provides a seal between bearing support housing 48 and drive housing 26 preventing entry of water forwardly into bore 28. Flats 61 on washer 60 engage flats 49 on housing 48 to lock the washer 60 against rotation relative to housing 48. Tabs 63 on washer 60 are bent outwardly into slotted recesses 55 on locking member 54 to prevent rotation of member 54 relative to washer 60, which in turn prevents rotation of member 54 relative to housing 48. Housing 48 is then locked into bore 28 by the noted reverse threads 50 and 56. Spool retaining structure for submerged drives using a set screw is known in the prior art, for example U.S. Pat. No. 4,897,058.

The spool assembly includes an aft bearing support portion 64, FIG. 3, extending rearwardly outwardly from housing 26. Needle bearing 66 is positioned between propeller shaft 42 and bearing support housing 48 in extended bearing support portion 64 such that the propeller shafts are supported over a length to prevent bending of the propeller shafts during the surface operation of the propellers as the propellers strike and pierce the surface of the water. Bearings in rearwardly extended spool portions are known in the prior art, for example U.S. Pat. No. 4,897,058. One or more seals 68, 70 are positioned between propeller shaft 42 and extended bearing support portion 64 of the spool assembly and aft of bearing 66 to prevent entry of water forwardly into the space between propeller shaft 42 and the spool assembly.

A pinion driving gear 72, FIG. 3, is mounted on the lower end of vertical driveshaft 32 in splined relation and is held thereon by nut 74. A fore driven gear 76 is fixed on inner propeller shaft 40 in splined relation and is engaged by pinion gear 72 for drivingly rotating inner propeller shaft 40. An aft driven gear 78 is fixed on outer propeller shaft 42 in splined relation and is engaged by pinion gear 72 for drivingly rotating outer propeller shaft 42 in the opposite rotational direction as inner propeller shaft 40. A tapered roller thrust bearing 80 supports driven gear 76 for rotation in bore 28 of housing 26. Bearing 80 has an inner race 82 engaging gear 76, and an outer race 84 engaging housing 26. A shim 86 may be provided if desired for adjusting axial positioning. A second tapered roller thrust bearing 88 supports the aft driven gear for rotation in bore 28 of housing 26. Bearing 88 has an inner race 90 engaging gear 78, and an outer race 92 engaging housing 26. Outer race 92 has a rearward end portion 94 facing the spool assembly and held thereby against axial movement, to prevent rearward movement of gear 78. Spacer washer 96 is provided between rearward end 94 of outer race 92 and forward end 97 of bearing support housing 48 of spool assembly 38.

A thrust bearing assembly 98, FIG. 3, engages between the propeller shafts such that thrust from outer propeller shaft 42 is transferred to inner propeller shaft 40 during rotation of the propeller shafts in opposite directions. Inner propeller shaft 40 extends through fore driven gear 76 and aft driven gear 78. Outer propeller shaft 42 extends through aft driven gear 78. Inner propeller shaft 40 has an annular shoulder 100 against which the thrust from outer propeller shaft 42 is transferred. Thrust bearing assembly 98 is mounted between shoulder 100 and the forward axial end 102 of outer propeller shaft 42. Thrust bearing assembly 98 is located axially between fore driven gear 76 and aft driven gear 78, such that thrust is transferred from outer propeller shaft 42 to inner propeller shaft 40 at an axial position on the propeller shafts located between gears 76 and 78. Thrust bearing assembly 98 includes a thrust bearing 104 engaging shoulder 100 of inner propeller shaft 40, and an annular cup-shaped thrust member 106 engaging thrust bearing 104 and the forward end 102 of outer propeller shaft 42 to transfer thrust from outer propeller shaft 42 to inner propeller shaft 40. Snap ring 108 stops rearward movement of the shaft in the reverse direction. The propeller shafts are allowed to slide fore and aft within their respective gears 76 and 78 along their respective splines, providing a floating shaft arrangement, without loading the gears. Thrust bearing assembly 98 is a double speed bearing and accommodates the opposite rotational directions of the propeller shafts.

One or more annular seals 110, 112, FIG. 3, are positioned between inner propeller shaft 40 and outer propeller shaft 42 at the propeller mounting end of propeller shaft 40 such that water is prevented from entering forwardly into the space between the propeller shafts. A needle bearing 114 is positioned between inner propeller shaft 40 and outer propeller shaft 42 and forward of seals 110, 112. Propeller shaft 40 has a stainless steel outer surface 116 rearward of seals 110, 112, and a carbon steel outer surface 118 forward of the seals at bearing 114. In one embodiment, inner propeller shaft 40 is a two piece member formed by a forward carbon steel piece and a rearward stainless steel piece welded to each other at a weld joint 120 between bearing 114 and the seals 110, 112. In another embodiment, inner propeller shaft 40 is a stainless steel member having a carbon steel sleeve therearound at bearing 114. Outer propeller shaft 42 has a stainless steel outer surface 122 rearward of seals 68, 70, and a carbon steel outer surface 124 forward of the seals at bearing 66. In one embodiment, outer propeller shaft 42 is a two piece member formed by a forward carbon steel piece and a rearward stainless steel piece welded to each other at a weld joint 126. In another embodiment, outer propeller shaft 42 is a stainless steel member having a carbon steel sleeve therearound at bearing 66.

Self-centering mounting structure is provided for the propellers on each propeller shaft. Inner propeller shaft 40 has a tapered shoulder outer surface 128, FIG. 3, a threaded outer surface 130 axially spaced rearwardly of tapered outer surface 128, and a driving spline 132 therebetween and drivingly engaging propeller 12 in splined relation. An annular ring 134 of a material, e.g. bronze, non-fretting relative to stainless steel, has an inner tapered surface 136 engaging tapered outer surface 128 of inner propeller shaft 40. Ring 134 has a tapered outer surface 138. An internally threaded nut 140 of a material, e.g. bronze, non-fretting relative to stainless steel, threadingly engages threaded outer surface 130 of inner propeller shaft 40. Nut 140 has a tapered outer surface 142. Propeller 12 is mounted on inner propeller shaft 40 between ring 134 and nut 140 and is engaged forwardly at tapered outer surface 138 of ring 134, and is engaged rearwardly at tapered outer surface 142 of nut 140. Tapers 138 and 142 provide a tight self-centering fit and mounting of the propeller to the propeller shaft. Splines 132 do not provide a tight fit, but merely rotational drive.

Outer propeller shaft 42 has a tapered shoulder outer surface 144, FIG. 3, a threaded outer surface 146 axially spaced rearwardly of tapered outer surface 144, and a driving spline 148 therebetween for drivingly engaging propeller 14 in splined relation. A ring 150 of a material, e.g. bronze, non-fretting relative to stainless steel, has a tapered inner surface 152 engaging tapered outer surface 144 of outer propeller shaft 42. Ring 150 has a tapered outer surface 154. An internally threaded nut 156 of a material, e.g. bronze, non-fretting relative to stainless steel, threadingly engages threaded outer surface 146 of outer propeller shaft 42. Nut 156 has a tapered outer surface 158. Propeller 14 is mounted on outer propeller shaft 42 between ring 150 and nut 156 and is engaged forwardly at tapered outer surface 154 of ring 150, and is engaged rearwardly at tapered outer surface 158 of nut 156. Tapers 154 and 158 provide a tight self-centering fit. Splines 148 do not provide a tight fit, but only rotational drive.

Vertical driveshaft 32, FIG. 2, is supported at its top end by a needle bearing 160 as in the above incorporated patents. The driveshaft is supported at its lower end by a needle bearing 162. Driveshaft 32 is centrally supported in bore 30 by tapered roller thrust bearing 164 retained by threaded ring 166. Driveshaft 32 is also supported by needle bearing 168 in upper spool 170 mounted at threads 172 in bore 30, and also having a needle bearing 174 supporting gear 176 of upper gear assembly 24. Reference is made to commonly owned co-pending U.S. application Ser. No. 07/889,495, filed on even date herewith, entitled "Counter-rotating Surfacing Marine Drive".

Cooling water for the engine is supplied from water intake 178 in skeg 180. The water flows through skeg passage 182, torpedo nose passage 184 and then through housing passage 186 and then to the engine in the usual manner. After cooling the engine, the water and the engine exhaust are exhausted in the usual manner through an exhaust elbow and through the drive housing and are discharged at exhaust outlet 188 above torpedo 34 and into the path of the propeller blades in the upper portion of their rotation, as in U.S. Pat. No. 4,871,334. Oil circulates from the lower gears upwardly through passages 190 and 192 to the upper gears and then downwardly through passage 194 to the lower gears at passages 196 and 197. Passage 196 supplies oil through passage 198 in the spool assembly to bearings 88 and 66, and through passage 199 in outer propeller shaft 42 to bearing 114. Passage 197 supplies oil to the forward end of bearing 88.

It is recognized that various equivalents, alternatives and modifications are possible within the scope of the appended claims.

We claim:

1. A marine drive comprising:

a housing having a horizontal bore and an intersecting vertical bore therein;

a first inner propeller shaft;

a second hollow outer propeller shaft positioned over said first propeller shaft to form a dual propeller shaft assembly, said dual propeller shaft assembly positioned in said horizontal bore, said first propeller shaft counter-rotating with respect to said second propeller shaft;

a vertical driveshaft positioned in said vertical bore;

a pinion driving gear mounted on the lower end of said vertical driveshaft;

a fore driven gear on said first inner propeller shaft and engaged by said pinion gear to drivingly rotate said first propeller shaft in a first rotational direction;

an aft driven gear on said second propeller shaft and engaged by said pinion gear to drivingly rotate said second propeller shaft in a second rotational direction, said second propeller shaft extending axially through said aft driven gear, said aft driven gear being axially slidable along said second propeller shaft, said fore and aft driven gears being axially spaced by a gap therebetween.

2. The invention according to claim 1 comprising a thrust bearing engaging between said first and second propeller shafts such that forward thrust from said second propeller shaft is transferred to said first propeller shaft.

3. The invention according to claim 1 comprising a retaining member in said axial gap between said fore and aft driven gears and fixed on said second propeller shaft against axial movement relative thereto and engageable with said aft driven gear to stop rearward axial movement of said second propeller shaft.

4. The invention according to claim 3 comprising a thrust bearing in said axial gap between said fore and aft driven gears and engaged between said first and second propeller shafts and transferring forward thrust from said second propeller shaft to said first propeller shaft, said thrust bearing being axially spaced forwardly of said aft driven gear by a second axial gap, said retaining member being in said second axial gap between said thrust bearing and said aft driven gear.

5. A marine drive having two counter-rotating surface operating propellers comprising:

a housing having a horizontal bore and an intersecting vertical bore therein;

a vertical driveshaft positioned in said vertical bore;

a pinion driving gear mounted on the lower end of said vertical driveshaft;

a first inner propeller shaft and a second hollow outer propeller shaft, said second propeller shaft positioned over said first propeller shaft to form a dual propeller shaft assembly, said dual propeller shaft assembly positioned in said horizontal bore;

a first surface operating propeller and a second surface operating propeller, each of said first and second propellers mounted to a respective one of said first and second propeller shafts, one of said propellers being a right hand rotation surface operating propeller, the other of said propellers being a left hand rotation surface operating propeller;

a first driven gear fixed on said first propeller shaft for engagement with said pinion gear for drivingly rotating said first propeller shaft in a first rotational direction;

a second driven gear fixed on said second propeller shaft for engagement with said pinion gear for drivingly rotating said second propeller shaft in a second rotational direction; and spool means having a bearing support housing fixed in said horizontal bore for supporting said propeller shaft assembly, said bearing support housing formed as a first cylindrical member, and a locking member fixed in said horizontal bore adjacent said bearing support housing, said locking member formed as a second cylindrical member surrounding the second propeller shaft.

6. The apparatus defined in claim 5 further comprising:

a tapered roller thrust bearing support said second driven gear for rotation in said housing, said tapered roller thrust bearing having an inner race engaging said second driven gear, and an outer race engaging said housing, said outer race having a rearward end portion facing said spool means whereby rearward movement of said second driven gear is prevented.

7. The apparatus defined in claim 5 wherein said spool means is mounted within said horizontal bore in said housing by a first right hand thread set and a second axially spaced left hand thread set.

8. A marine drive having two counter-rotating surface operating propellers comprising:

a housing having a horizontal bore and an intersecting vertical bore therein;

spool means positioned in said horizontal bore, a first inner propeller shaft and a second hollow outer propeller shaft, said second propeller shaft positioned concentrically over said first propeller shaft, said second propeller shaft being supported by said spool means, said first propeller shaft rotating in a first rotational direction, said second propeller shaft rotating in a second opposite rotational direction;

a first surface operating propeller mounted to said first propeller shaft and a second surface operating propeller mounted to said second propeller shaft, one of said propellers being a right hand rotating propeller, the other of said propellers being a left hand rotating propeller; and retaining means for holding said spool means fixed for non-rotation within said horizontal bore in both said first rotational direction and said second rotational direction as said propellers strike and pierce the surface of the water, wherein said retaining means for holding said spool means fixed comprises:

a first right hand thread set in said horizontal bore; and a second left hand thread set in said horizontal bore, said thread sets being spaced along the rotational axis of said first and second propeller shafts, such that said right hand thread set prevents right hand rotational loosening of said spool means, and said left hand thread set prevents left hand rotational loosening of said spool means.

9. The apparatus defined in claim 8 wherein said spool means further includes:

a bearing support housing having a first mounting thread thereon for engagement with a mating thread in said housing; and a locking member having a second opposite hand thread to said first mounting thread for engagement with a mating thread in said housing and for clamping against said bearing support housing to fix the rotational and axial position of both said bearing support housing and said locking member in said horizontal bore whereby rotation of said spool means is prevented in each rotational direction.

10. A marine drive comprising:

a housing having a horizontal bore and an intersecting vertical bore therein;

a first inner propeller shaft;

a second hollow outer propeller shaft positioned over propeller shaft to form a dual propeller shaft assembly, said dual propeller shaft assembly positioned in said horizontal bore, said first propeller shaft counter-rotating with respect to said second propeller shaft;

a vertical driveshaft positioned in said vertical bore;

a pinion driving gear mounted on the lower end of said vertical driveshaft;

a fore driven gear on said first propeller shaft and engaged by said pinion gear to drivingly rotate said first propeller shaft in a first rotational direction;

an aft driven gear on said second propeller shaft and engaged by said pinion gear to drivingly rotate said second propeller shaft in a second rotational direction, said fore and aft driven gears being separated by an axial gap therebetween;

a thrust bearing transferring forward thrust from said second propeller shaft to said first propeller shaft at a location aft of said fore driven gear.

11. The invention according to claim 10 wherein said first propeller shaft has an annular shoulder aft of said fore driven gear and engaged by said thrust bearing and receiving thrust from said second propeller shaft, such that thrust from said second propeller shaft is transferred through said thrust bearing to said first propeller shaft at said annular shoulder.

12. The invention according to claim 11 wherein said annular shoulder on said first propeller shaft is in said axial gap between said fore and aft driven gears and faces rearwardly toward said aft driven gear.

13. The invention according to claim 12 wherein said second propeller shaft has a forward end in said axial gap between said fore and aft driven gears and spaced rearwardly of said annular shoulder on said first propeller shaft by a second axial gap, said thrust bearing being in said second axial gap and engaged by said forward end of said second propeller shaft and said annular shoulder on said first propeller shaft.

14. A marine drive comprising:

a housing having a horizontal bore and an intersecting vertical bore therein;

a first inner propeller shaft;

a second hollow outer propeller shaft positioned over said first propeller shaft to form a dual propeller shaft assembly, said dual propeller shaft assembly positioned in said horizontal bore, said first propeller shaft counter-rotating with respect to said second propeller shaft;

a vertical driveshaft positioned in said vertical bore;

a pinion driving gear mounted on the lower end of said vertical driveshaft;

a fore driven gear on said first inner propeller shaft and engaged by said pinion gear to drivingly rotate said first propeller shaft in a first rotational direction;

an aft driven gear on said second propeller shaft and engaged by said pinion gear to drivingly rotate said second propeller shaft in a second rotational direction;

a tapered roller bearing supporting said aft driven gear for rotation in said housing, said tapered roller bearing having an inner race engaging said aft driven gear, and an outer race engaging said housing;

a threaded locking member engaging said housing in thread mounted relation within said horizontal bore and holding said tapered roller bearing in place and preventing rearward movement of said tapered roller bearing and said aft driven gear.

15. The invention according to claim 14 wherein said second propeller shaft extends axially through said aft driven gear, and said aft driven gear is axially slidable along said second propeller shaft.

16. The invention according to claim 15 wherein:

said fore and aft driven gears are axially spaced by a gap therebetween;

said first propeller shaft has an annular shoulder in said axial gap between said fore and aft driven gears and facing rearwardly toward said aft driven gear;

said second propeller shaft has a forward end in said axial gap between said fore and aft driven gears and spaced rearwardly of said annular shoulder on said fist propeller shaft by a second axial gap;

and comprising:

a thrust bearing in said second axial gap between said forward end of said second propeller shaft and said annular shoulder on said first propeller shaft and transferring forward thrust from said second propeller shaft to said first propeller shaft;

a retaining member on said second propeller shaft between said thrust bearing and said aft driver gear, said retaining member being fixed on said second propeller shaft against axial movement relative thereto and engageable with said aft driven gear to stop rearward axial movement of said second propeller shaft.

17. A marine drive comprising:

a housing having a horizontal bore and an intersecting vertical bore therein;

a spool positioned in said horizontal bore;

a first inner propeller shaft and a second hollow outer propeller shaft, said first propeller shaft being within said second propeller shaft and spaced therefrom by a first annulus, said second propeller shaft being within said spool and spaced therefrom by a second annulus;

a first aft bearing within said first annulus and supporting said first propeller shaft for rotation within said second propeller shaft;

a second aft bearing within said second annulus and supporting said second propeller shaft for rotation within said spool;

a first oil passage comprising a passage in said housing supplying oil to said second annulus to lubricate said second aft bearing;

a second oil passage comprising a passage in said second propeller shaft supplying oil from said second annulus to said first annulus to lubricate said first aft bearing.

18. The invention according to claim 17 wherein said first oil passage is forward of said second aft bearing, and said second oil passage is forward of said second aft bearing and rearward of said first oil passage.

19. The invention according to claim 18 comprising a third oil passage comprising a passage in said spool communicating between said first oil passage and said second annulus.

20. The invention according to claim 19 wherein said third oil passage is forward of said second oil passage.

21. The invention according to claim 18 comprising:

a vertical driveshaft positioned in said vertical bore;

a pinion driving gear mounting on the lower end of said vertical driveshaft;

a first driven gear on said first propeller shaft and engaged by said pinion gear and drivingly rotating said first propeller shaft in a first rotational direction;

a second driven gear on said second propeller shaft and engaged by said pinion gear and drivingly rotating said second propeller shaft in a second rotational direction;

a tapered roller thrust bearing supporting said second driven gear for rotation in said housing;

a first passage in said housing supplying oil to said horizontal bore rearwardly of said tapered roller thrust bearing to lubricate said tapered roller thrust bearing and said second aft gear;

a second passage in said housing supplying oil to said horizontal bore forwardly of said tapered roller thrust bearing to lubricate said tapered roller thrust bearing.

* * * * *